US005279375A

United States Patent [19]

Tibbitts et al.

[11] Patent Number: 5,279,375

[45] Date of Patent: Jan. 18, 1994

[54] MULTIDIRECTIONAL DRILL BIT CUTTER

[75] Inventors: Gordon A. Tibbitts; William R. Trujillo, both of Salt Lake City, Utah

[73] Assignee: Baker Hughes Incorporated, Houston, Tex.

[21] Appl. No.: 846,216

[22] Filed: Mar. 4, 1992

[51] Int. Cl.[5] ..... E21B 9/08

[52] U.S. Cl. ..... 175/428; 175/434

[58] Field of Search ..... 175/425, 426, 428, 432, 175/434

[56] References Cited

U.S. PATENT DOCUMENTS

| | | | |
|---|---|---|---|
| 2,264,440 | 12/1941 | Haulick | 175/434 |
| 2,511,831 | 6/1950 | Adamson | 255/71 |
| 2,911,196 | 11/1959 | Cameron et al. | 255/301 |
| 4,081,203 | 3/1978 | Fuller | 308/4 A |
| 4,109,737 | 8/1978 | Bovenkerk | 175/329 |
| 4,150,728 | 4/1979 | Garner et al. | 175/432 X |
| 4,215,999 | 8/1980 | Phall | 51/295 |
| 4,255,165 | 3/1981 | Dennis et al. | 51/309 |
| 4,452,325 | 6/1984 | Radd et al. | 174/410 |
| 4,525,178 | 6/1985 | Hall | 51/309 |
| 4,570,726 | 2/1986 | Hall | 175/410 |
| 4,719,979 | 1/1988 | Jones | 175/329 |
| 4,813,500 | 3/1989 | Jones | 175/329 |
| 4,858,706 | 8/1989 | Lebourg | 175/329 |
| 4,858,707 | 8/1989 | Jones et al. | 175/329 |
| 4,872,520 | 10/1989 | Nelson | 175/329 |
| 5,137,098 | 8/1992 | Raffaelli | 175/434 X |

FOREIGN PATENT DOCUMENTS

| | | |
|---|---|---|
| 2504589 | 10/1982 | France . |
| 679193 | 12/1964 | Italy . |

*Primary Examiner*—William P. Neuder

*Attorney, Agent, or Firm*—Marger, Johnson, McCollom & Stolowitz, Inc.

[57] ABSTRACT

A multidirectional drill bit cutter comprising a cylindrical stud having a layer of polycrystalline diamond formed thereabout. In one embodiment the stud is fortified with diamond grit and diamond rods to reduce stud wear and to reduce the depth of cut taken by the polycrystalline diamond cutting element formed about the stud. In another aspect of the invention, an earth-boring drilling system having a pair of flat profile bits utilizes multidirectional cutters in a manner which causes them to cut from a plurality of different directions.

24 Claims, 4 Drawing Sheets

MULTIDIRECTIONAL DRILL BIT CUTTER

BACKGROUND OF THE INVENTION

1. Field of the Invention

The present invention relates to a cutter for an earth boring drill bit and more particularly to such a cutter comprising a central stud adapted for mounting on the bit body and having a layer of abrasive material, such as polycrystalline diamond, formed about the circumference thereof.

2. Description of the Related Art

One type of earth-boring drag bit includes a bit body having a plurality of cylindrical studs extending from the crown thereof. Each of the studs includes a polycrystalline diamond (PCD) cutting element mounted thereon. The cutting element is typically in the shape of a cylindrical disk having one side thereof bonded to the stud. The cutting elements are oriented so that when the bits are set on the bottom of a borehole an edge of each cutting element, and a portion of the stud upon which the cutting element is mounted, abuts against the formation. As the bit rotates, the stud wears away more rapidly than the PCD cutting element thereby forming a cutting element lip which extends beyond the stud. It is the edge of this lip which cuts rock from the formation as the bit rotates.

When drilling in hard and sometimes abrasive formations, the stud may wear rapidly thus leaving a relatively large lip which breaks off as a result of the forces applied to it during drilling. Although it is normal for the outermost portion of the lip to break off from time to time as the stud wears away, if this occurs too frequently wear is very high and the rate of penetration may be reduced. It would be desirable to provide a cutting element on a drill bit in which lip size is limited even in hard or abrasive formations. It would also be desirable to design a lip depth for a bit used in a particular formation.

The usual drill bit of the type above described rotates about a central axis. The cutters on such a bit therefore cut in only a single direction, namely the direction of cutter movement during bit rotation. Some bits, however, require cutters which can cut from more than a single direction. For example, some bits are constructed to create a bore which turns rather than simply having a straight axis. Such bits can be navigated to create a curved bore. When such a bit turns, the cutters thereon cut in a different direction than when the bit moves along a straight axis. It would be desirable to provide such a drill bit with a cutter which could cut in any direction.

Another problem inherent in using a conventional drill bit to drill hard formations is that the center of the axis of rotation the velocity of the bit is very low. It would be desirable to provide a drilling system which provided relatively uniform cutter velocity across the entire bottom surface of the borehole.

SUMMARY OF THE INVENTION

A cutter for an earth boring drill bit comprises an elongate stud having a central axis therethrough. A layer of abrasive material is formed on the surface of the stud about the perimeter thereof. In another aspect of the invention an earth boring drill bit is provided which includes a plurality of such cutters.

In still another aspect of the invention, an earth boring drilling system which incorporates a plurality of the foregoing cutters is provided. The system includes two drill bits having different axes of rotations and a collar for maintaining the axes a fixed distance from one another. The collar in turn rotates about a third axis of rotation thus causing cutters on the drill bits to cut from a plurality of different directions.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENTS

Figure 1:
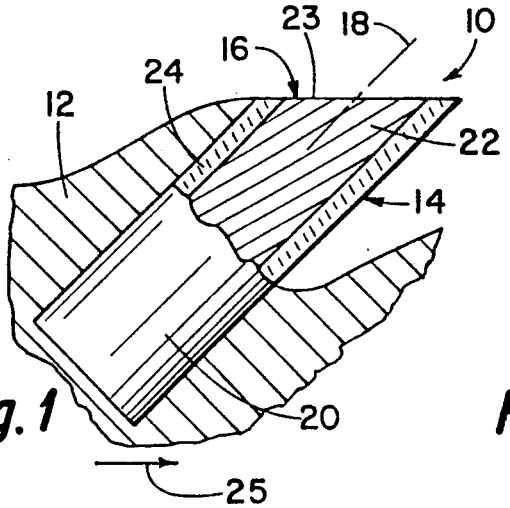
FIG. 1 is a partial, sectional view of a drill bit constructed in accordance with the present invention including a cutter shown partly in sectional view.

Indicated generally at 10 is a portion of a drill bit constructed in accordance with the present invention. The drill bit includes a bit body 12 having a cutter 14 mounted thereon. Bit body 12 is made from tungsten carbide, steel, combined technology known in the art or with any other known materials for making drill bits and may be formed using conventional matrix infiltration techniques so as to mold cutter 10 integrally therewith. Alteratively, the cutter may be mounted on the bit body, after the same is formed, using interference or other known bonding techniques. It should be appreciated that neither the composition of the bit body nor the technique used for mounting the cutter thereon are critical to the present invention.

Cutter 14 includes a generally cylindrical stud 16 having a longitudinal axis 18. Stud 16 includes a lower portion 20 which is received within bit body 12 and an upper portion 22 which partially extends from the bit body. Stud 16 is formed from tungsten carbide or steel but may be formed from another suitable material.

Upper portion 22 includes an abrasive layer 24 of polycrystalline diamond. Stud 16 includes an exposed surface 23 at the upper most end thereof. Layer 24 is substantially tubular in shape and is generally concentric, with respect to axis 18, with stud 16. An arrow 25 indicates generally the direction of cutter movement when drill bit 10 rotates.

Figure 2:
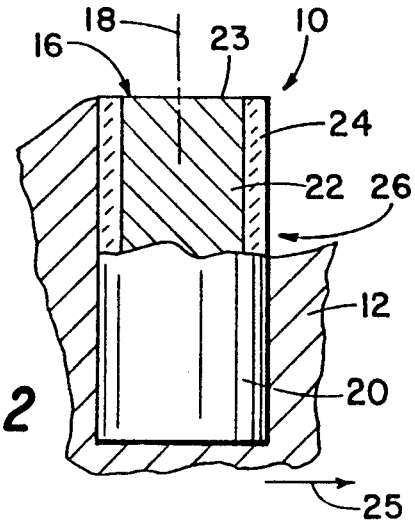
FIG. 2 is a partial, sectional view of a second embodiment of a drill bit constructed in accordance with the present invention including a cutter shown partly in sectional view.

Turning to FIG. 2, a second cutter 26 has structure corresponding to that previously identified on cutter 14 in FIG. 1 identified with the same numeral in FIG. 2. As can be seen, cutter 26 includes a surface 23 which is normal to axis 18. The exposed surface of layer 24 thus presents a different rake angle than the exposed surface of layer 24 on cutter 14.

Figure 3:
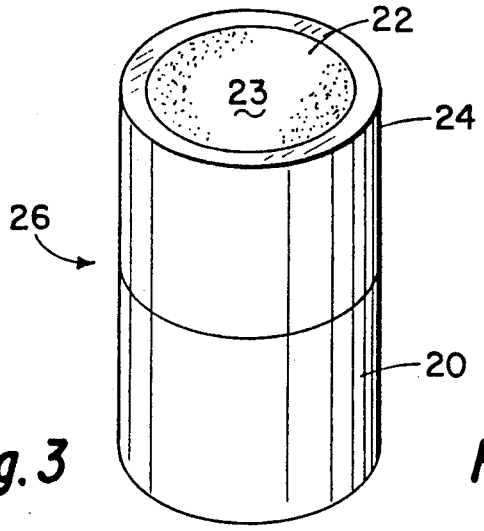
FIG. 3 is a perspective view of the cutter shown in FIG. 2.

With reference to FIG. 3, it can be seen that upper portion 22 of stud 16 includes abrasive material, in the embodiment of FIGS. 2 and 3 comprising hard material, such as diamond grit, embedded therein. The abrasive material is distributed throughout upper portion 22 so that as it wears during drilling abrasive material is always exposed on surface 23. Considering now another cutter 28 in FIG. 4, which also has previously described structure identified with corresponding numerals, cutter 28 further includes a plurality of hard rods, such as polycrystalline diamond rods, one of which is rod 30, disposed substantially parallel to the longitudinal axis of cutter 28, in upper portion 22 of the stud. The exposed rod ends on surface 23 thus present a hard, abrasive surface.

Figure 4:
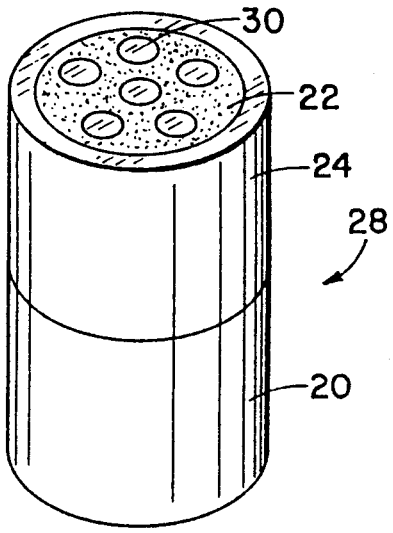
FIG. 4 is a perspective view of another embodiment of a cutter constructed in accordance with the present invention.

Cutters constructed in accordance with the present invention can be manufactured utilizing different known techniques. For example, diamond grit is dispersed in sinterable carbide molding powder in a mold shaped like stud 16. The invention may also be practiced by utilizing only the carbide powder without any grit dispersed therein. When making a cutter having rods, like rod 30, disposed therein, the rods are positioned in the mold as illustrated in FIG. 4. Known sintering or infiltration techniques are used to mold the carbide integrally with the diamond grit and rods. The invention may also be implemented with cutters having other than round cross sections, like the cutter in FIG. 4, such as a hexagonal cross section. Also possible are cutters having asymmetrical cross sections.

The cutters of the present invention can be constructed in a number of ways other than as described above. For example, high pressure formation techniques may be used with free carbon on the inside either with or without diamond grit or other hard material dispersed in the core which may form hard carbides and/or diamond grit. Stud 16 can be formed using high pressure techniques and thereafter a diamond film may be formed on the exterior of the stud to form layer 24 using chemical vapor deposition (CVD). CVD processes have been used for many years in the semiconductor industry to deposit layers of material in the formation of semiconducting devices. As set forth in DeVries, Synthesis of Diamond Under Metastable Conditions, Annual Review Material Science Vol. 17, p. 161 (1987) and Badzian, Crystallization of Diamond from the Gas Phase, Material Research Bulletin, March (1988), similar techniques may be used to deposit PCD layers on cutter studs.

When using infiltration techniques as in the embodiment of FIG. 1, either simultaneously with infiltration of the carbide stud, or in a separate later step, cutter 14 is bonded to bit body 12. In the case where cutter 14 is previously formed, the finished cutter, e.g., as illustrated in FIG. 4, is positioned inside a bit body mold. Thereafter carbide powder is packed in the mold which is heated using known technology to form the carbide bit body about the cutter. In the case where the cutter and bit body are formed simultaneously, tubular PCD layer 24 is preformed using high temperature and pressure in a known manner. The PCD layer may thereafter have the metal leached therefrom, also in a known process, to increase the thermal stability of the PCD layer. PCD having silicon formed therein may also be used. After the tubular layer is formed, it is positioned in a bit body mold with rods 30 and carbide powder mixed with diamond grit is packed into tubular PCD layer 24 to form upper portion 22. Thereafter the mold is filled with powder and all of the carbide powder, including that forming the bit body in upper portion 22 is infiltrated to form the cutters and bit body integrally. Alternately, once a stud is formed, it may be mounted on a previously formed bit body using known techniques or may be integrally cast in a bit as described above.

In operation, the drill bit of either FIG. 1 or FIG. 2 presents a surface 23 which is harder than the usual cutter stud. This is especially so when diamond rods 30 are formed in the cutter. Thus, in hard formations, exterior PCD layer 24 presents a hard surface which cuts the formation. At the same time, surface 23 prevents the cutter from digging too deeply into the formation thereby damaging the cutter or slowing the rate of penetration. When prior art cutters dig in hard formations, the stud is rapidly worn away leaving only the diamond cutting edge which tends to dig deeply into the formation. This can slow drilling and/or damage the diamond cutting edge in hard formations.

Figure 5:
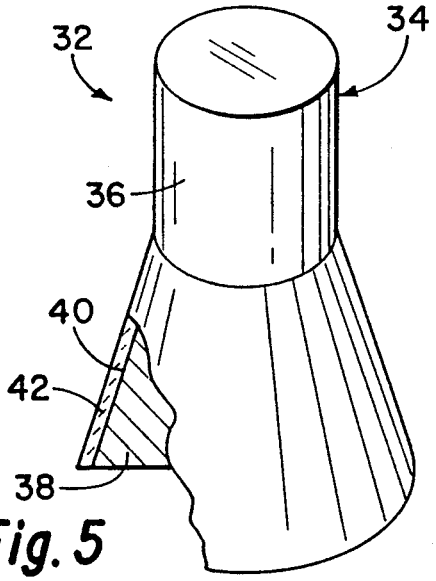
FIGS. 5–8 are perspective views of different cutters constructed in accordance with the present invention with portions of the cutter in FIGS. 5, 6 and 8 shown partly in sectional view.

Turning now to FIG. 5, indicated generally at 32 is a cutter constructed in accordance with the present invention. Cutter 32 includes a stud 34 having a cylindrical portion 36 joined to a frusto-conical portion 38. In the present embodiment of the invention, stud 34 is made from carbide but it should be appreciated that it could be made from steel or another suitable material.

Portion 38 includes a frusto-conical surface 40 which extends from the lower end of the cutter to cylindrical portion 36. A PCD layer 42 is formed on surface 40. As described above, known techniques can be used to shape layer 42 and to bond it to stud 34. Cylindrical portion 36 is used to mount cutter 32 in a known manner on a drill bit body (not shown) having corresponding recesses formed therein.

Figure 6:
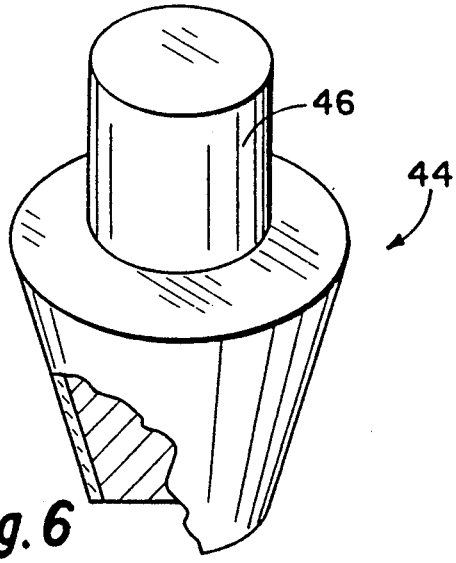

Indicated generally at 44 in FIG. 6 is another cutter constructed in accordance with the present invention. Cutter 44 is similar to cutter 32 except that frusto-conical portion 38 is inverted in cutter 44 to provide a different cutter rake angle. As with the embodiment of FIG.

5, cylindrical portion 46 is provided for mounting the stud on a drill bit body.

Figure 7:
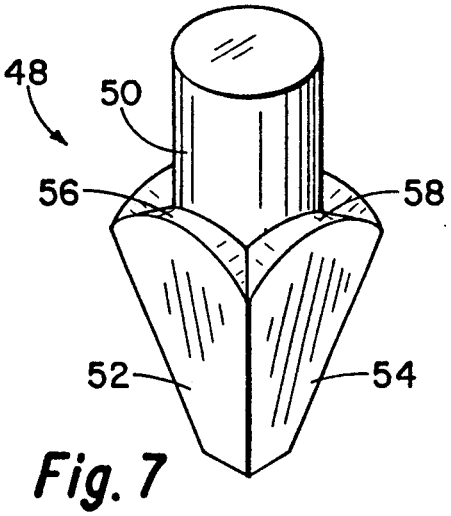

Turning now to FIG. 7, indicated generally at 48 is another cutter constructed in accordance with the present invention. Cutter 48, like the cutters in FIGS. 5 and 6, includes a cylindrical portion 50 for mounting the cutter on a drill bit body. Cutter 48 includes four planar surfaces, only two of which are visible, namely surfaces 52, 54. Surface 52 is formed on a substantially planar PCD element 56 while surface 54 is formed on a substantially identical PCD element 58. The other two surfaces (not visible) are likewise formed from PCD elements substantially identical to elements 52, 54. Each of the four elements, like elements 52, 54, are bonded, e.g., by brazing, to a correspondingly shaped portion (not visible) of cutter 48 in the same manner that PCD layer 42 is bonded to surface 40 in the cutter of FIG. 5.

Figure 8:
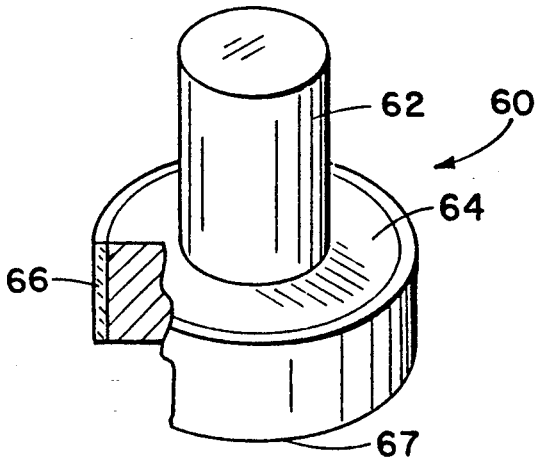

Turning now to FIG. 8, indicated generally at 60 is another cutter constructed in accordance with the present invention. Cutter 60 includes a cylindrical portion 62 by which the cutter can be mounted on a drill bit body. A cylindrical disk 64 is formed on the lower end of cylindrical portion 62 with portions 62, 64 together comprising a carbide stud. A PCD layer 66 is formed on the radially outer surface of cylindrical disk 64 in the same fashion as with the previously-described cutters. A lower edge 67 of layer 66 provides a cutting edge.

Figure 9:
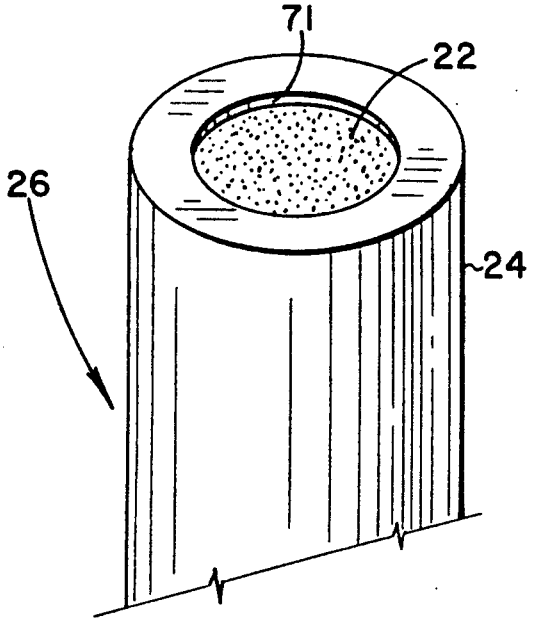
FIG. 9 is a perspective view of the drill bit of FIG. 3 after it has been used to cut rock in all directions.
Figure 10:
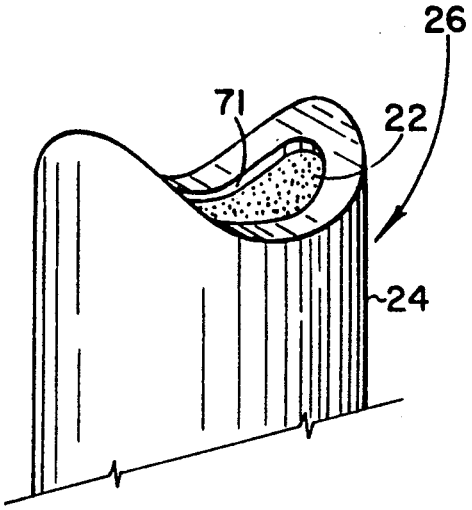
FIG. 10 is a perspective view of the drill bit of FIG. 3 after it has been used to cut rock only in the direction of the arrow.

In FIGS. 9 and 10, drill bit 26 from FIG. 3 is shown after being subject to two types of wear. In FIG. 9, the upper (as viewed in the drawing) surface of the bit has been used to cut in all directions. One type of drilling system in which cutters cut in all directions is later described herein with reference to FIGS. 13 and 14. As can be seen, a lip 71 forms where the core wears away faster than the exterior layer. A person having ordinary skill in the art can construct a core and exterior layer which, with a particular formation, produces core wear at a predetermined rate so as not to expose a lip which is long enough to cause it to break off at a rate which produces undesirable penetration. In FIG. 10, cutter 26 from FIG. 3 is shown after being subject to wear only in the direction of the arrow.

Figure 11:
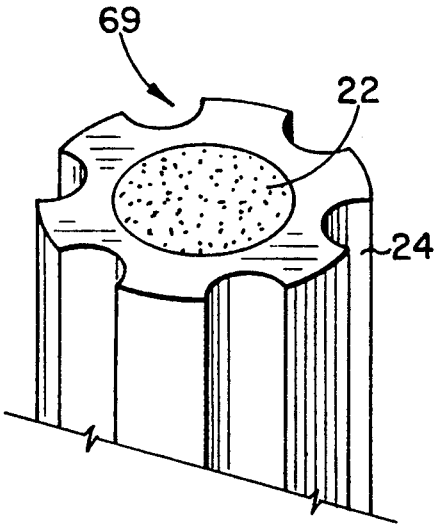
FIG. 11 is a perspective view of another cutter constructed in accordance with the present invention.
Figure 12:
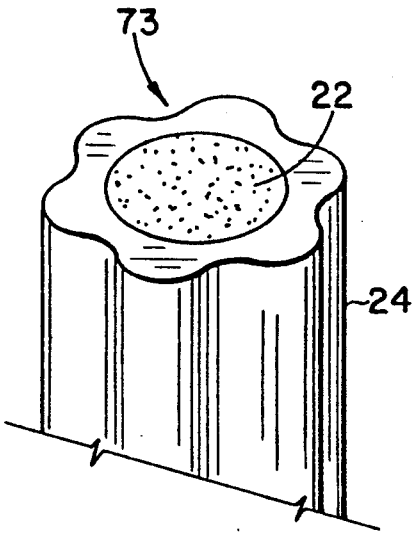
FIG. 12 is a perspective view of still another cutter constructed in accordance with the present invention.
Figure 11A:
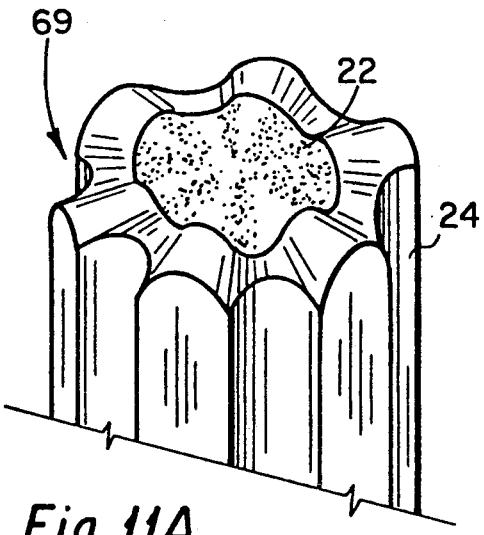
FIG. 11A is a perspective view of the cutter of FIG. 11 after it has been used to cut rock in all directions.
Figure 11B:
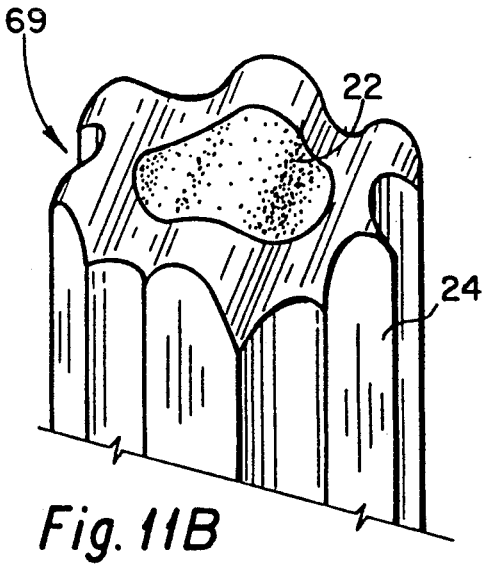
FIG. 11B is a perspective view of the cutter of FIG. 11 after it has been used to cut rock only in the direction of the arrow.
Figure 11C:
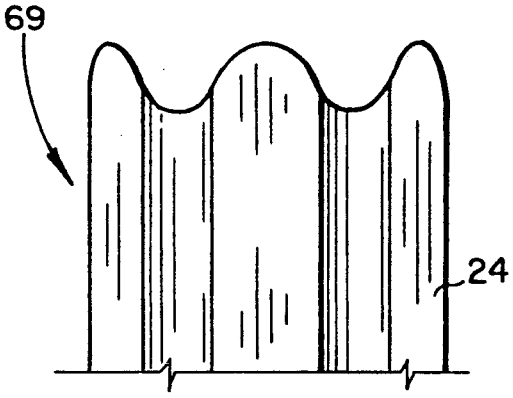
FIG. 11C is a side elevation view of the cutter of FIG. 11B.
Figure 12A:
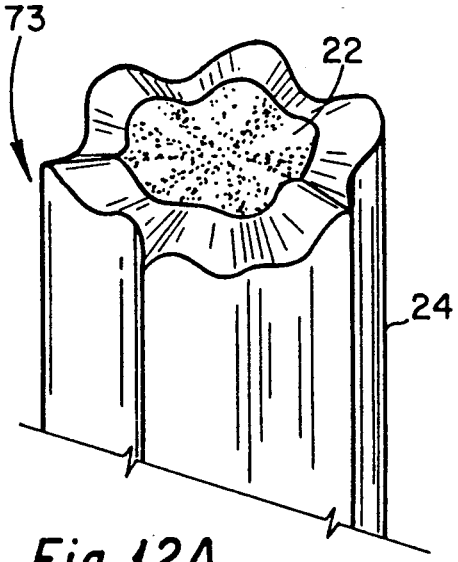
FIG. 12A is a perspective view of the cutter of FIG. 12 after it has been used to cut rock in all directions.
Figure 12B:
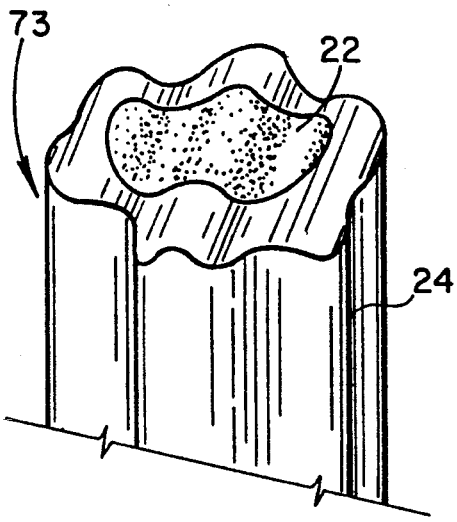
FIG. 12B is a perspective view of the cutter of FIG. 12 after it has been used to cut rock only in the direction of the arrow.

In each of FIGS. 11 and 12, structure corresponding to that in previously described cutters herein retains the same numeral. The cutters in FIG. 11 and 12 each include studs and abrasive layers formed according to any of the previously described techniques. In FIG. 11 a cutter 69, also constructed in accordance with the present invention is shown in an unworn condition. The cutter is shown in FIG. 11A with wear produced by cutting in all directions and in FIG. 11B with wear produced by cutting only in the direction of the arrow. FIG. 11C is a side elevation view of the worn cutter of FIG. 11B. FIG. 12 illustrates an unused cutter 73 with FIG. 12A illustrating the cutter as worn in all directions and FIG. 12B illustrating cutter wear in the direction of the arrow.

A PCD layer could be formed on any of the foregoing cutters using the CVD methods previously referred to.

Figure 13:
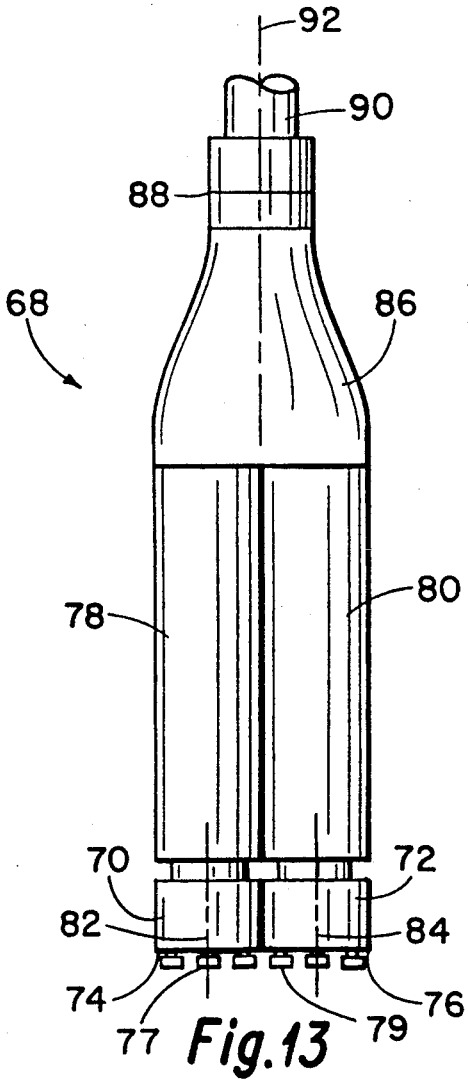
FIG. 13 is a highly diagrammatic elevation view of a drilling system constructed in accordance with the present invention.
Figure 14:
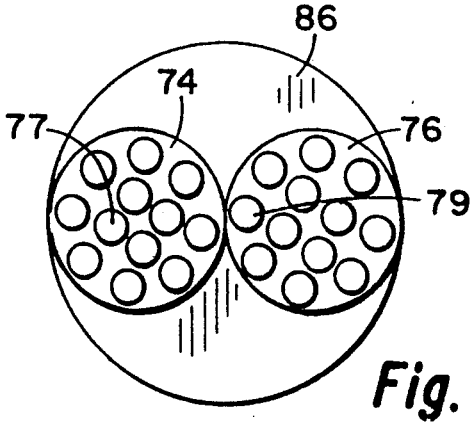
FIG. 14 is a slightly enlarged bottom plan view of the drilling system of FIG. 13.

Turning now to FIGS. 13 and 14, indicated generally at 68 is an earth-boring drilling system constructed in accordance with the present invention. Included therein is a first drill bit 70 and a second drill bit 72. Each of drill bits 70, 72 are of the type having a flat profile, such referring to substantially planar lower surfaces 74, 76 on drill bits 70, 72, respectively. Each drill bit has cutters, like cutter 77 on drill bit 70 and cutter 79 on drill bit 72, which extend downwardly from surfaces 74, 76. In the embodiment of FIGS. 13 and 14, each of the cutters, like cutters 77, 79, on the drill bits are substantially identical to cutter 60 in FIG. 8.

Each of drill bits 70, 72 is operatively connected to an associated hydraulic motor 78, 80, respectively. Motors 78, 80 rotate in response to drilling mud circulating therethrough. Motor 78 rotates drill bit 70 about an axis 82 while motor 80 rotates drill bit 72 about an axis 84. Down-hole hydraulic motors, like motors 78, 80, are known in the art.

Each of motors 78, 80 is fixed relative to the other by a coupling 86 which is mounted on the upper ends of each motor. Bands 87, 89 maintain the motors fixed together. A threaded connection 88 is formed between coupling 86 and a string of drill pipe 90. Drill pipe 90 is rotatable in the usual fashion about an axis 92.

In operation, drilling system 68 is lowered into a borehole via drill string 90. Drilling mud is circulated down drill pipe 90 and through motors 78, 80 thereby causing the motors to rotate bits 70, 72 about their associated axes 82, 84, respectively. The drilling mud circulates out the lower end of the bits via ports (not shown) to cool the cutters on the drill bits and flush cuttings to the surface in the annulus between the drill string and radially inner surface of the borehole. The cutters, like cutters 77, 79, on drill bits 70, 72, respectively, are abutted against the bottom of the borehole. Next, drill string rotation is commenced in a known fashion by equipment on the rig platform (not shown) at the surface of the borehole. Thus, drilling system 68 in its entirety rotates about axis 92 while each of drill bits 70, 72 rotate about their respective axes 82, 84. One or both of bits 70, 72 may be freewheeling (not driven) when the system is drilling, i.e., during rotation about axis 92.

Figure 15:
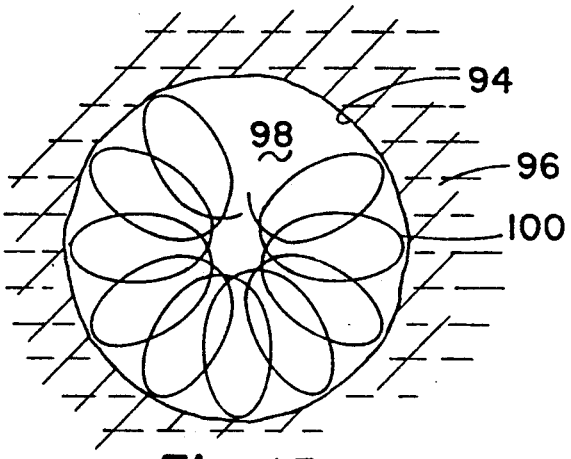
FIG. 15 is a diagrammatic view looking down a borehole and illustrating the path of a single cutter during operation of the drilling system of FIGS. 13 and 14.

Turning to FIG. 15, a borehole 94 is formed in a formation 96. A relatively flat surface 98 defines the lower end of the borehole. A pattern 100 on surface 98 illustrates the path of travel of a single cutter on one of drill bits 70, 72 as drilling system 68 operates as described above. It can be seen that the cutting edge, like cutting edge 67 in FIG. 8, on each of the cutters on the lower end thereof cuts in a plurality of different directions and not just on a single point or side of the cutter. Thus, a cutter having a round cutting surface, like the cutters of FIGS. 5, 6 and 8, is especially well adapted to be used as a cutter in drilling system 68. Use of abrasive material, such as diamond grit, in cylindrical disk 64 and use of diamond rods, like rod 30 in FIG. 4, in disk 64 provide the advantages described above, namely reduced stud wear and decreased depth of cut taken by cutting edge 67.

Having illustrated and described the principles of my invention in a preferred embodiment thereof, it should be readily apparent to those skilled in the art that the invention can be modified in arrangement and detail without departing from such principles.

I claim all modifications coming within the spirit and scope of the accompanying claims:

1. A cutter for an earth boring drill bit comprising:
   an elongate stud having a central axis therethrough;
   a layer of abrasive material formed on the surface of said stud about the perimeter thereof, said abrasive material having a rate of wear less than said stud; and
   a cutter wear surface defined in part by said stud and in part by said abrasive material.

2. The cutter of claim 1 wherein said stud is substantially cylindrical in shape.

3. The cutter of claim 2 wherein said abrasive layer comprises a polycrystalline layer, and wherein said layer is substantially tubular in shape.

4. The cutter of claim 1 wherein said stud includes a conical surface upon which said polycrystalline layer is formed.

5. The cutter of claim 4 wherein said conical surface comprises a portion of a frusto-conical surface.

6. The cutter of claim 5 wherein said stud further includes a cylindrical portion mounted on one end of said frusto-conical portion and coaxial therewith.

7. The cutter of claim 6 wherein said cylindrical stud portion has an exposed radially outer surface upon which no polycrystalline layer is formed.

8. The cutter of claim 3 wherein said stud is formed from tungsten carbide.

9. The cutter of claim 8 wherein said tungsten carbide is impregnated with abrasive material.

10. The cutter of claim 9 wherein said abrasive material comprises diamond.

11. The cutter of claim 9 wherein said abrasive layer is concentric with said stud.

12. An earth boring drill bit comprising:

a bit body having a substantially flat profile and a central axis of rotation;

a plurality of elongate studs, each of which has a central axis therethrough, said studs being fixedly mounted on the flat portion of said bit and spaced away from the central axis of said bit body;

a layer of abrasive material formed on the surface of each of said studs about the perimeter thereof; and a wear surface which bears against an earth formation during drilling, said wear surface including said studs and said abrasive material.

13. The drill bit of claim 12 wherein said studs are substantially cylindrical in shape.

14. The drill bit of claim 13 wherein said abrasive layer comprises a polycrystalline layer and wherein said layer is substantially tubular in shape.

15. The drill bit of claim 12 wherein said studs include a conical surface upon which said polycrystalline layer is formed.

16. The drill bit of claim 15 wherein said conical surface comprise a portion of a frusto-conical surface.

17. The drill bit of claim 16 wherein said studs further include a cylindrical portion mounted on one end of said frusto-conical portion and coaxial therewith.

18. The drill bit of claim 17 wherein said cylindrical stud portions have an exposed radially outer surface upon which no polycrystalline layer is formed.

19. The drill bit of claim 14 wherein said studs are formed from tungsten carbide.

20. The drill bit of claim 19 wherein said tungsten carbide is impregnated with abrasive material.

21. The drill bit of claim 20 wherein said abrasive material comprises diamond.

22. The drill bit of claim 12 wherein said abrasive layer is concentric with its associated stud.

23. An earth boring drilling system comprising:

a first drill bit having a substantially flat profile and having a first axis of rotation;

a plurality of elongate studs, each of which has a central axis therethrough, said studs being mounted on the flat portion of said bit;

a layer of abrasive material formed on the surface of each of said studs about the perimeter thereof;

a second drill bit having a plurality of abrasive cutters formed thereon and having a second axis of rotation parallel to said first axis;

coupling for maintaining said first and second axes spaced a fixed distance from one another, and means for rotating said coupling about a third axis of rotation.

24. The earth boring drilling system of claim 23 wherein said drilling system further includes a wear surface which bears against an earth formation during drilling, said wear surface including said studs and said abrasive method.

* * * * *